US005830163A

United States Patent [19]

Obermaier

[11] Patent Number: 5,830,163

[45] Date of Patent: Nov. 3, 1998

[54] FOOT MASSAGE APPARATUS

[75] Inventor: Anton Obermaier, Prien-Bachham, Germany

[73] Assignee: Gebruder Obermaier oHG, Germany

[21] Appl. No.: 695,865

[22] Filed: Aug. 9, 1996

[30] Foreign Application Priority Data

Oct. 18, 1995 [DE] Germany ..... 195 38 814.3
May 23, 1996 [EP] European Pat. Off. ..... 96108274

[51] Int. Cl.[6] ..... A61H 7/00

[52] U.S. Cl. ..... 601/134; 601/28; 601/148

[58] Field of Search ..... 601/134, 148, 601/27, 28, 136, 138

[56] References Cited

U.S. PATENT DOCUMENTS 4,175,297 11/1979 Robbins et al. ..... 601/148
5,158,073 10/1992 Bukowski .
5,490,821 2/1996 Wu ..... 601/134

FOREIGN PATENT DOCUMENTS 1 152 398 8/1983 Canada .
1 901 488 7/1964 Germany .
32 47 435 6/1984 Germany .
3837821 A1 5/1990 Germany ..... 601/134
89 06 148.9 8/1990 Germany .
2 282 969 4/1995 United Kingdom .

*Primary Examiner*—Richard J. Apley
*Assistant Examiner*—Benjamin K. Koo
*Attorney, Agent, or Firm*—Anthony J. Casella; Gerald E. Hespos; Ludomir A. Budzyn

[57] ABSTRACT

The present invention relates to a foot massage apparatus having a flat hollow base body 1 of resilient material which is filled with a fluid and has a profiled top side. In accordance with the invention, the base body 1 is divided substantially perpendicular to its flat length into two adjacent chambers 2, 3 which enclose separate fluid containers 4, 5 and are connected integrally by a common stiff bottom 6.

9 Claims, 1 Drawing Sheet

FOOT MASSAGE APPARATUS

BACKGROUND OF THE INVENTION

1. Field of the Invention

The present invention relates to a foot massage apparatus which can be used in many ways for massage of the feet, for instance in the home, at the place of work, or in fitness centers.

2. Description of the Prior Art

A prior art electrically operated foot massage apparatus includes a vibrating foot resting surface on which the foot can be placed. These foot massage apparatus are sold both as dry massage apparatus and as trough-shaped, wet massage apparatus which can be filled with water. These prior art foot massage apparatus have the disadvantage of an expensive electric drive. The limited massaging effect resulting from the generally rigid foot resting surfaces is also a disadvantage.

An electric drive is dispensed with in one known foot massage apparatus in which a plurality of rollers having a profiled surface are mounted axially for free rotation in a frame and placed in rotation by the backward and forward movement of the feet of the user. This has the disadvantage, in the same way as the electrically operated foot massage apparatus indicated above, of a limited massaging effect due to the rigid surface of the rolls.

A foot massage apparatus is known from British 22 28 969 A. That known foot massage apparatus consists of a plurality of air-inflatable rectangular hollow bodies which are provided on their top with nubs which are arranged in a row one after the other by end connecting elements. A successful massage with this known foot massage apparatus requires a relatively large amount of space. Thus, this foot massage apparatus is less suitable for use at home and the workplace, since the necessary space is generally not available there. This known foot massage apparatus also has the disadvantage that a large number of individual hollow bodies must be connected in a relatively expensive manner to one another. The casting of the individual hollow bodies is also expensive, due to their rectangular shape. Finally, this known foot massage apparatus is less suitable for static loading by the feet of the user, for instance when sitting or standing, but serves for the running or walking user.

From Federal Republic of Germany 89 06 148 U1 a bristle cushion is known which is integrated with a waist band in order to massage certain parts of the body by vibration. This bristle cushion is little suited for the specific massage of the feet.

From German Utility Model 19 01 488, a foot mat is known on the top side of which there are nub-like elevations. This foot mat does not have a resilient underpad and is therefore not able to adapt itself sufficiently to the structure of the sole of the foot.

The object of the present invention is therefore to provide a foot massage apparatus which, while taking up only a small amount of space and being of a simple construction which can be manufactured without problem, produces an optimal massaging effect for the feet of the user without the user being forced to walk along a massage path.

SUMMARY OF THE INVENTION

The invention provides a foot massage apparatus based on separate massage units for the left foot and the right foot, which units, however, in order to assure a compact construction and to permit static loading by the feet of the user, lie directly alongside of each other. In other words, the user can use the foot massage apparatus of the invention either sitting or standing without having to walk over a long massage path as in the aforementioned prior art. From this, there is obtained the advantage that the massage apparatus of the invention can easily be used everywhere, even in places where a large amount of space is not available. The essential difference between sitting and standing use of the foot massage apparatus of the invention consists therein that, in the case of standing use, greater forces are exerted on the soles of the feet by the weight of the user.

One important aspect of the present invention is that the foot massage apparatus is developed in two chambers, whereby assurance is had that the massage is effected separately for each foot. Upon standing use, this assures a stable position of the user since the vibrating movement of the one cushion or one chamber is not transmitted to the other chamber or cushion. The independent floating support of each foot of the user upon the massaging makes it possible, in a unique manner, for the soles of the feet not only to be massaged with full support by the movement of the feet out of the ankles, but it also can be acted on with massage pressure in bearing directions. In this way, on the one hand, the circulation of the sole of the foot is promoted and, on the other hand, the muscles of the arch of the foot as well as the ankles are strengthened to an extent that is not possible with any previously known foot massage apparatus.

The development of the foot massage apparatus with an integrally continuous bottom in accordance with the invention assures its easy manufacture. In particular, the preferred development of the two chambers in semicircular or kidney shape, i.e. of the foot massage apparatus as a whole as an apparatus of substantially rotational symmetry permits its easy manufacture as a rotary casting.

In accordance with the invention, it is furthermore provided that the entire bottom of the two chambers be relatively stiff, preferably by the use of a form stabilizing plate which is inserted into the bottom of the base body, preferably in an undercut edge. The stiff development of the bottom provides assurance that the two chambers of the foot massage apparatus are completely uncoupled dynamically from each other upon use. In other words, there is no transfer of vibration between the two chambers from the one chamber to the other via the bottom upon use, so that the two feet of the user can actually be massaged independently of each other.

The two chambers of the foot massage apparatus are preferably filled with a slight excess pressure by a gas, which may suitably be air, in such a manner that the foot resting surfaces extend approximately in a plane in the condition of rest not acted on by the user. In this way, when the foot massage apparatus is employed in standing position, the stability of the position of the user is promoted and furthermore the result is obtained that a maximum spring path perpendicular to the foot resting surfaces is always assured. The fact that the inside height of the chambers is less than their inside width also contributes to stabilizing the position of the user.

In accordance with an advantageous further development of the invention, the two chambers are spaced laterally from each other by such an amount that the surrounding side walls of the chambers do not come into contact with each other by a bulging of their side walls upon the use of the foot massage apparatus. This benefits the independence of the gas-filled chambers upon the use of the foot massage apparatus, i.e. the movement dynamics of the one chamber are always—even upon extreme loading of the chambers—optimally uncoupled from those of the other chamber.

In principle, all known profilings are suitable as profile of the foot resting surfaces of the two cushions or chambers of the foot massage apparatus of the invention. However, a profiling of these surfaces in the form of nubs which are preferably spaced uniformly apart and advantageously have conically tapering and preferably rounded tips is particularly advantageous.

The foot massage apparatus of the invention can be manufactured inexpensively in one piece as a rotary casting.

The invention is not limited to the two chambers being filled with gas. Rather, other fluids can also enter into consideration for the filling of the chambers, such as, for instance, liquids. In one embodiment, the two chambers are, however, in fluid communication in order to permit an alternate walking of the user on the two chambers, fluid being forced from the chamber acted on by the pressure into in each case the other chamber.

BRIEF DESCRIPTION OF THE DRAWINGS

The invention will be described in further detail below by way of example with reference to the drawing, in which.

DETAILED DESCRIPTION OF THE PREFERRED EMBODIMENT

Figure 1:
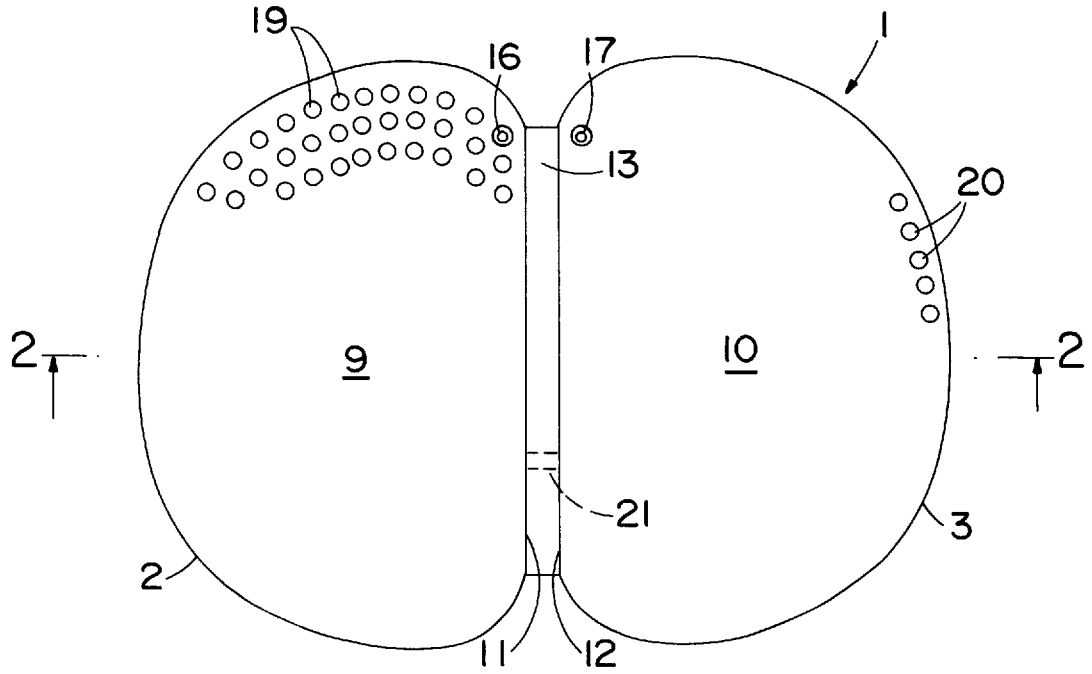
FIG. 1 is a plan view of the foot resting surfaces of the two-chamber foot massage apparatus of the invention.
Figure 2:
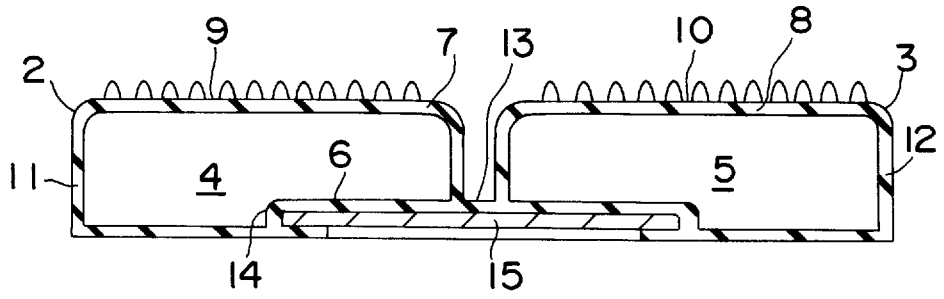
FIG. 2 is a cross-sectional view of the foot massage apparatus of FIG. 1, seen perpendicular to the division of the base body of the foot massage apparatus into the two chambers.

As shown in FIGS. 1 and 2, the foot massage apparatus comprises a flat hollow base body 1 of substantially circular contour consisting of resilient material. In accordance with the invention, the hollow body 1 is divided into two equally large chambers or cushions 2 and 3 arranged alongside of each other. The chambers 2 and 3 contain, fully separated from each other, spaces 4 and 5 respectively filled with a fluid, preferably a gas, especially air. The two chambers 2 and 3 have a common bottom 6 and otherwise separate wall parts, including a cover 7 and 8 respectively with a profiled foot resting surface 9 and 10 respectively, the profile shape of which will be described in further detail below. The covers 7 and 8 are connected as one piece with the bottom 6 by side walls in the form of surrounding edges 11 and 12 respectively. Leaving a bottom web 13 in the region of the division of the base body 11 into the two chambers 2 and 3, the surrounding side walls 11 and 12 are spaced from each other by a predetermined amount. This space, or the width of the bottom web 13, is so selected that the regions of the chamber side walls 11 and 12 lying opposite each other do not contact each other when the foot resting surfaces 7 and 8 are duly placed under load in accordance with their intended purpose.

On the lower side of the bottom 6 there is a central recess with a surrounding undercut edge 14 which is, for instance, circular and receives a stabilization plate 15, which is also circular. The purpose of the plate 15 is to stiffen the bottom 6 so that it retains its flat shape when the base body 1, resting on a firm base, is dynamically loaded via the foot resting surfaces 8 and 9.

The reference numerals 16 and 17 in the embodiment shown designate valves which open into the foot resting surfaces 9 and 10 and through which the chambers 2 and 3 are filled separately with air under a predetermined pressure which is selected so high that the foot resting surfaces extend approximately flat in unloaded state.

As already stated, the foot resting surfaces 9 and 10 of the chambers 2 and 3 are provided with a profiling in order to promote the massaging action. The profiling is preferably in the form of nubs 19 and 20 which are formed, spaced uniformly from each other, substantially over the entire surfaces 9 and 10. The nubs have a cylindrical base and conically tapering tips which are rounded.

The foot massage apparatus shown in FIGS. 1 and 2 is preferably developed as an injection molding in one piece, for instance from a thermosetting resin.

The manner of operation of the foot massage apparatus has already been described above.

The foot massage apparatus of the invention which has been described above preferably has the following dimensions: The maximum inside width of each cushion or chamber 2 or 3 is about 23 cm; its maximum inside length is about 33 cm. The width of the web 13 between the two chambers 2 and 3 is preferably about 4 mm; the inside height of each chamber is about 6 cm. Depending on the material, the thickness of the thermosetting resin used for the foot massage apparatus is about 5 mm. The nubs have a preferred total height of about 8 mm and a diameter (nub base) of about 6 mm.

In an alternative embodiment, the chambers 2 and 3 may be joined by a conduit 21, as shown in FIG. 1 in broken lines. With the conduit 21, the spaces 4 and 5 are in fluid communication, wherein fluid may be forces from one chamber into the other.

What is claimed is:

1. A foot massage apparatus comprising two spaced-apart fluid-filled chambers formed of resilient material, and a common stiff bottom, both said chambers being integrally connected to said stiff bottom, said chambers being each formed with a profiled top side spaced from said stiff bottom, wherein a stabilizing plate (15) is inserted into a central recess in the bottom (6) of the base body, which recess has an undercut edge (14), the recess extending within the region of both chambers (3, 4).

2. A foot massage apparatus according to claim 1, characterized by the fact that the two chambers are of the same size and shape and are filled with air.

3. A foot massage apparatus according to claim 1, characterized by the fact that the chambers are of approximately semi-circular shape.

4. A foot massage apparatus according to claim 1, wherein the chambers extend from said bottom in a direction generally perpendicular to said bottom to define an inside height, the chambers also define an inside width perpendicular to the inside height, wherein the inside height of the chambers is less than their inside width.

5. A foot massage apparatus according to claim 1, characterized by the fact that each chamber has a surrounding side wall which connects to a cover forming a foot resting surface parallel to the bottom.

6. A foot massage apparatus according to claim 5, characterized by the fact that the fluid contained in the two chambers is sufficiently pressurized to cause the foot resting surfaces to extend and be generally flat in an unloaded condition.

7. A foot massage apparatus according to claim 6, characterized by the fact that the foot resting surfaces of the two chambers are provided with outward projecting nubs.

8. A foot massage apparatus according to claim 1, characterized by the fact that said chambers are spaced apart on said stiff bottom to define a space therebetween.

9. A foot massage apparatus according to claim 1, characterized by the fact that the two chambers are in fluid communication.

* * * * *